US009141020B2

(12) United States Patent
Uenishi et al.

(10) Patent No.: US 9,141,020 B2
(45) Date of Patent: Sep. 22, 2015

(54) CHARGER POSITIONING ADJUSTER AND IMAGE FORMING APPARATUS INCORPORATING SAME

(71) Applicants: Hiroyuki Uenishi, Kanagawa (JP); Hirotaka Hatta, Kanagawa (JP); Toshiya Sato, Kanagawa (JP); Takeshi Kojima, Kanagawa (JP); Akira Asaoka, Kanagawa (JP); Yusuke Ishizuka, Kanagawa (JP)

(72) Inventors: Hiroyuki Uenishi, Kanagawa (JP); Hirotaka Hatta, Kanagawa (JP); Toshiya Sato, Kanagawa (JP); Takeshi Kojima, Kanagawa (JP); Akira Asaoka, Kanagawa (JP); Yusuke Ishizuka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/205,621

(22) Filed: Mar. 12, 2014

(65) Prior Publication Data

US 2014/0270847 A1 Sep. 18, 2014

(30) Foreign Application Priority Data

Mar. 14, 2013 (JP) ..... 2013-052016

(51) Int. Cl.
*G03G 15/02* (2006.01)
*G03G 21/16* (2006.01)

(52) U.S. Cl.
CPC ..... *G03G 15/0291* (2013.01); *G03G 21/1647* (2013.01); *G03G 21/1661* (2013.01); *G03G 15/0258* (2013.01)

(58) Field of Classification Search
USPC ..... 399/115
See application file for complete search history.

(56) References Cited

U.S. PATENT DOCUMENTS 5,440,375 A * 8/1995 Fujisawa et al. ..... 399/171
2013/0279939 A1* 10/2013 Nagamori et al. ..... 399/171

FOREIGN PATENT DOCUMENTS

JP 3-101767 4/1991

* cited by examiner

*Primary Examiner* — Clayton E Laballe
*Assistant Examiner* — Jas Sanghera
(74) *Attorney, Agent, or Firm* — Harness, Dickey & Pierce, P.L.C.

(57) ABSTRACT

A charger positioning adjuster, which is included in an image forming apparatus and disposed facing a charger uniformly charging a surface of an image carrier using corona discharging, includes a mounting part provided at a position on which the charger is detachably attached, a positioning member attached to the mounting part and positioning the charger by contacting thereto, and a spacer disposed between the mounting part and the positioning member and adjusting a distance between the surface of the image carrier and the charger.

13 Claims, 15 Drawing Sheets

CHARGER POSITIONING ADJUSTER AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2013-052016, filed on Mar. 14, 2013 in the Japan Patent Office, the entire disclosure of which is hereby incorporated by reference herein.

BACKGROUND

1. Technical Field

Embodiments of the present invention relate to a charger positioning adjuster to position a charger that uniformly charges a surface of an image carrier, and an electrophotographic image forming apparatus incorporating the charger positioning adjuster.

2. Related Art

Corona chargers or chargers using a corona discharging technique are known to uniformly charge a surface of an image carrier that is included in an electrophotographic image forming apparatus. The corona chargers are good for high-speed apparatuses for its wider range of application of a charging bias in comparison with those of a charging roller and a charging brush. Compared with low-speed or middle-speed apparatuses, typical high-speed apparatuses are requested to provide higher image quality, and therefore are demanded to have a higher level with respect to deviation in image concentration in a main scanning direction that is a longitudinal direction of the charger. To enhance the deviation of image concentration in the main scanning direction, various configurations have been disclosed to prevent occurrence of deviation of a surface potential of the image carrier in a main scanning direction by reducing the deviation of the distance between a corona charger and the image carrier in the main scanning direction. For example, Japanese Patent Application Publication JP H03-101767-A discloses a technique to automatically control a deviation of a distance between a charger and an image carrier by using an electric drive source in order to reduce the deviation of surface electric potentials after charging a surface of the image carrier.

Since the deviation of distances between the corona charger and the image carrier in the main scanning direction occurs due to variation of parts and/or assembly, it is less likely to cause fluctuation of the distances while the image forming apparatus is in operation.

Appropriate timing to adjust the deviation of the distances of the corona charger and the image carrier in the main scanning direction is before the factory shipping and/or at replacement of a corona charger. When the corona charger is integrally provided with a process cartridge, the deviation of the distances of the charger and the image carrier is also adjusted at replacement of the process cartridge.

Thus, if an electric drive source is used as disclosed in JP H03-101767-A, the deviation can be reduced even though the image forming apparatus is not used often. However, this configuration also requires an installation space and a drive transmission system to transmit a driving force of the electric drive source to the charger. Therefore, the configuration can be improved in order to achieve a simpler and more space-saving configuration.

SUMMARY

At least one embodiment of the present invention provides a charger positioning adjuster to adjust a charger that is disposed facing an image carrier and uniformly charges a surface of the image carrier using corona discharging. The charger positioning adjuster includes a mounting part that is provided at a position on which the charger is detachably attached, a positioning member that is attached to the mounting part and that positions the charger by contacting the charger, and a spacer that is disposed between the mounting part and the positioning member and that adjusts a distance between the surface of the image carrier and the charger.

Further, at least one embodiment of the present invention provides an image forming apparatus including the above-described charger positioning adjuster.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
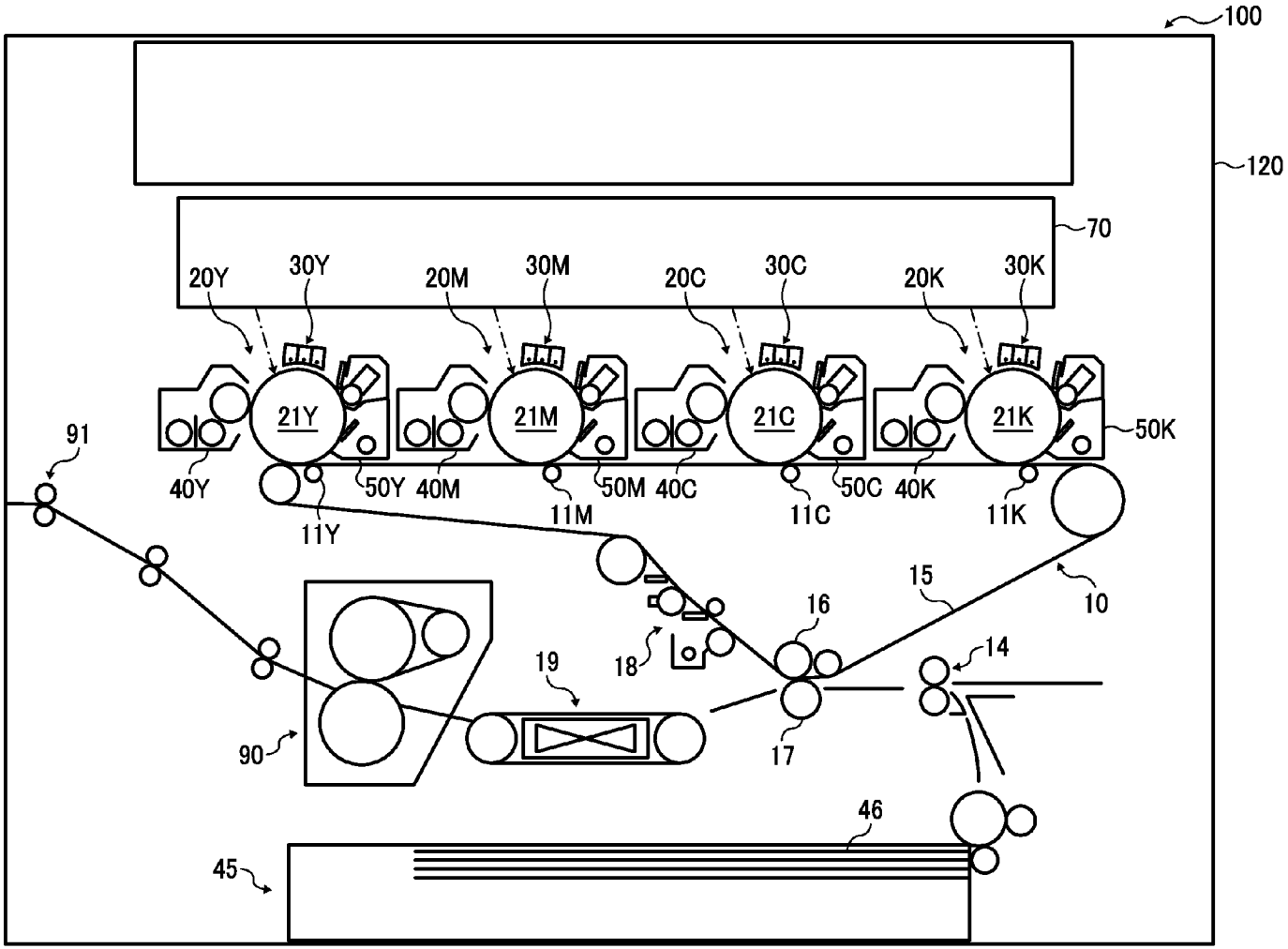
FIG. 1 is a diagram illustrating an entire configuration of an image forming apparatus according to an embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

A description is given of an image forming apparatus 100 according to an embodiment of the present invention.

The following description shows examples that do not fall under the restriction of the scope of claims. The present invention is not limited to the embodiments, and variations and modifications may be made without departing from the scope of the present invention.

The image forming apparatus 100 may be a copier, a facsimile machine, a printer, a plotter, a multifunction peripheral or a multifunction printer (MFP) having at least one of copying, printing, scanning, facsimile, and plotter functions, or the like. According to the present embodiment, the image forming apparatus 100 is an electrophotographic color printer that forms color and monochrome toner images on recording media by electrophotography.

Figure 2:
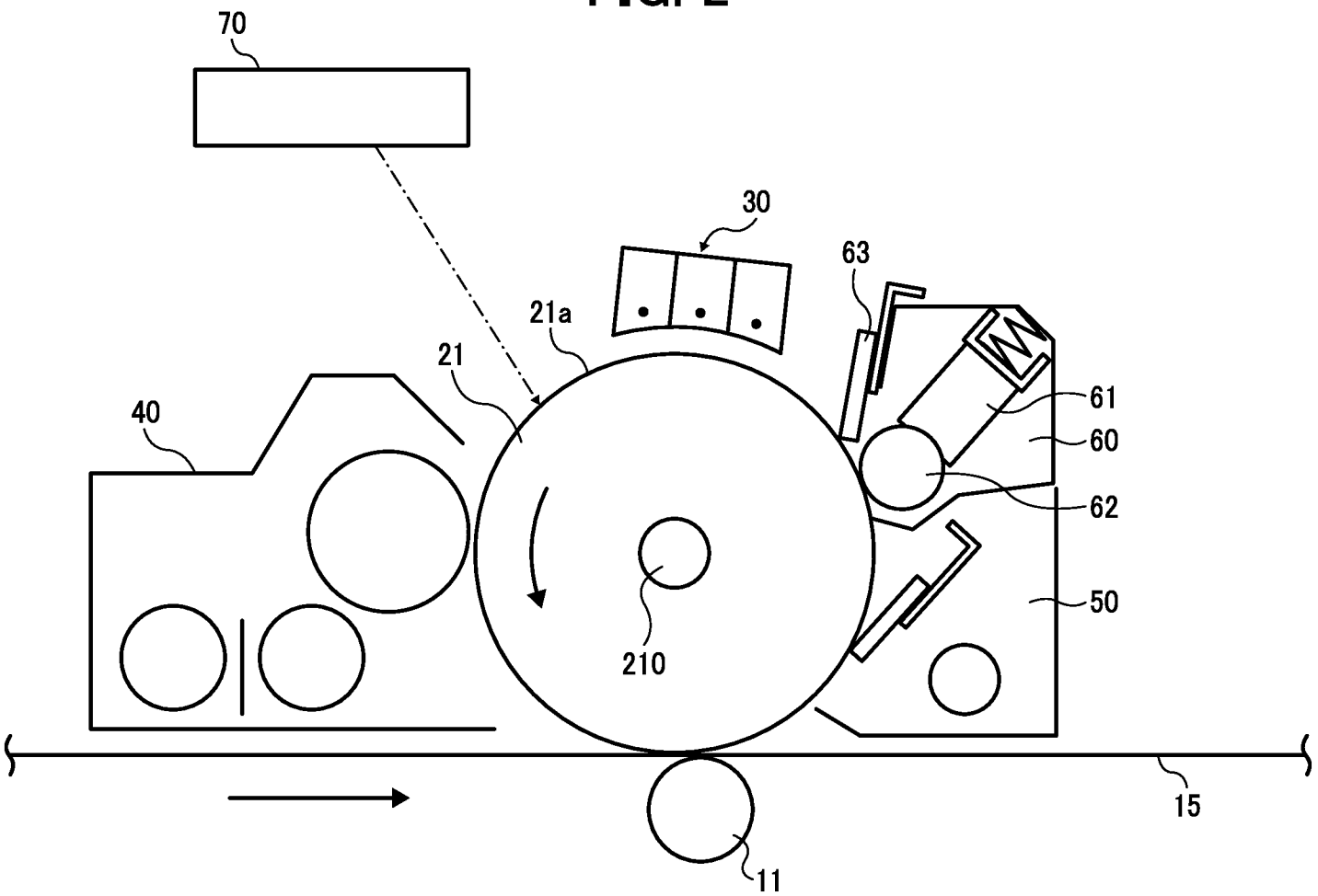
FIG. 2 is a diagram illustrating a configuration of an image forming part of the image forming apparatus illustrated in FIG. 1.

A description is given of a basic configuration of the image forming apparatus 100 with reference to FIGS. 1 and 2.

FIG. 1 is a diagram illustrating an entire configuration of the image forming apparatus 100 that forms color images. FIG. 2 is a diagram illustrating a process cartridge 20 that functions as an image forming part provided to the image forming apparatus 100.

FIG. 1 is a diagram illustrating a schematic entire configuration of the image forming apparatus 100. The image forming apparatus 100 shown in FIG. 1 is a color image forming apparatus to form a full color image based on image data of four different single color toners, which are yellow (Y), cyan (C), magenta (M), and black (K).

The image forming apparatus 100 forms a color image with toners serving as developers having four colors of yellow (Y), magenta (M), cyan (C), and black (K). The image forming apparatus 100 includes process cartridges 20Y, 20M, 20C, and 20K functioning as image forming units including drum-shaped photoconductors 21Y, 21M, 21C, and 21K, each functioning as an image carrier. The process cartridges 20Y, 20M, 20C, and 20K are detachably attached to an apparatus body 120 of the image forming apparatus 100 for replacement and maintenance by detaching from the apparatus body 120 of the image forming apparatus 100.

The process cartridges 20Y, 20C, 20M, and 20K form respective single color images of yellow (Y), cyan (C), magenta (M), and black (K), which are different from each other corresponding to color separation of a color image. Elements and components of the process cartridges 20Y, 20C, 20M, and 20K are similar in structure and functions, except that the respective single colors are different from each other. Hereinafter, the process cartridges 20Y, 20C, 20M, and 20K are also referred to as the process cartridge 20. Similarly, elements and components described below having the same configuration can be referred to with suffixes Y, M, C, and K or in a singular form.

The image forming apparatus 100 further includes an intermediate transfer device 10 disposed below the process cartridges 20Y, 20C, 20M, and 20K. The intermediate transfer device 10 includes an intermediate transfer belt 15 that functions as an endless intermediate transfer body. The intermediate transfer belt 15 is wound around multiple rollers and contacts a surface 21*a* of the photoconductor 21 (i.e., the photoconductors 21Y, 21M, 21C, and 21K) by a primary transfer roller 11 (i.e., primary transfer rollers 11Y, 11M, 11C, and 11K) functioning as a primary transfer member facing the photoconductor 21. That is, the intermediate transfer belt 15 is interposed between the photoconductor 21 and the primary transfer roller 11. Rotation of any of the multiple rollers moves the intermediate transfer belt 15 clockwise in FIG. 1 with the intermediate transfer belt 15 in contact with the surfaces 21*a* of the photoconductor 21.

The process cartridge 20 include a charger 30 (i.e., chargers 30Y, 30M, 30C, and 30K), a development device 40 (i.e., development devices 40Y, 40M, 40C, and 40K), and a cleaning device 50 (i.e., cleaning devices 50Y, 50M, 50C, and 50K). The charger 30 uniformly charges the surface 21*a* of the photoconductor 21. The development device 40 develops an electrostatic latent image formed on the surface 21*a* of the photoconductor 21 to a visible toner image of a single color different from the images of the other photoconductors 21. The cleaning device 50 removes and collects residual toner remaining on the surface 21*a* of the photoconductor 21 after transfer of the toner image. These image forming components are disposed around the photoconductor 21 and are detachably attached to the respective process cartridge 20.

As illustrated in FIG. 2, the process cartridge 20 further includes a lubricant application device 60 (i.e., lubricant application devices 60Y, 60M, 60C, and 60K) disposed adjacent to the cleaning device 50. The lubricant application device 60 includes a lubricant 61 (i.e., lubricants 61Y, 61M, 61C, and 61K), a lubricant application roller 62 (i.e., lubricant application rollers 62Y, 62M, 62C, and 62K), and a lubricant application blade 63 (i.e., lubricant application blade 63Y, 63M, 63C, and 63K). In order to protect the surface 21*a* of the photoconductor 21, the lubricant 61 is applied onto the surface 21*a* of the photoconductor 21 by the lubricant application roller 62 and the lubricant application blade 63.

The image forming apparatus 100 further includes a latent image forming device 70 provided in the apparatus body 120. The latent image forming device 70 emits laser light to irradiate the surface 21*a* of the photoconductor 21 charged by the charger 30 in the process cartridge 20, so that a latent image is formed on the surface 21*a* of the photoconductor 21. Then, the development device 40 supplies a given amount of toner from each of toner bottles respectively including yellow, magenta, cyan, and black toners to the latent image formed on the surface 21*a* of the photoconductor 21, so as to develop each visible toner image. By applying a transfer bias to the primary transfer roller 11 that contacts the intermediate transfer belt 15 to the photoconductor 21, the visible toner image is transferred onto a surface of the intermediate transfer belt 15.

Residual toner remaining on the surface 21*a* of the photoconductor 21 is removed and collected by the cleaning device 50, and conveyed via a conveying path in the cleaning device 50 to a toner recovery container that is disposed in the apparatus body 120 of the image forming apparatus 100. After the residual toner is removed and collected by the cleaning device 50, the lubricant application device 60 applies the lubricant 61 to the surface 21*a* of the photoconductor 21, so as to form a protection layer on the surface 21*a* of the photoconductor 21.

As a primary transfer process in a transfer process, yellow, magenta, cyan, and black toner images are subsequently transferred from the photoconductor 21 of the process cartridge 20 onto the surface of the intermediate transfer belt 15. Image forming operations for respective toner colors are performed by gradually shifting respective timings along an upstream side to a downstream side in a belt rotation direction of the intermediate transfer belt 15, so that the respective toner images are overlaid constantly at the same position on the intermediate transfer belt 15.

As illustrated in FIG. 1, the toner image formed on the intermediate transfer belt 15 is conveyed to a secondary transfer area by holding the intermediate transfer belt 15 between a secondary transfer roller 17 that functions as a secondary transfer member and an opposed roller 16 that is disposed facing the secondary transfer roller 17. In the secondary transfer area, the toner image formed on the intermediate transfer belt 15 is transferred on a sheet 46 that functions as a recording medium fed from a sheet tray 45 and conveyed by synchronizing a timing at a registration roller pair 14.

Residual toner remaining on the surface of the intermediate transfer belt 15 after secondary transfer is removed and collected by a belt cleaning device 18 of the intermediate transfer belt 15. Similar to the cleaning device 50 of the process cartridge 20, the residual toner is conveyed to the toner recovery container in the apparatus body 120 of the image forming apparatus 100.

The sheet 46 having the toner image transferred in the secondary transfer is conveyed to a fixing device 90 by a sheet conveying unit 19. The sheet 46 is fixed in the fixing device 90 by application of heat and pressure while being conveyed in the fixing device 90, and is discharged outside after the toner image is fused and fixed thereto.

Next, a description is given of the charger 30 and units disposed around the charger 30.

Since the chargers 30Y, 30M, 30C, and 30K have identical configurations except colors of toners, yellow, magenta, cyan and black, the configuration of the charger 30 and components included therein and their functions described below can be applied to any of the chargers 30Y, 30M, 30C, and 30K.

Figure 3:
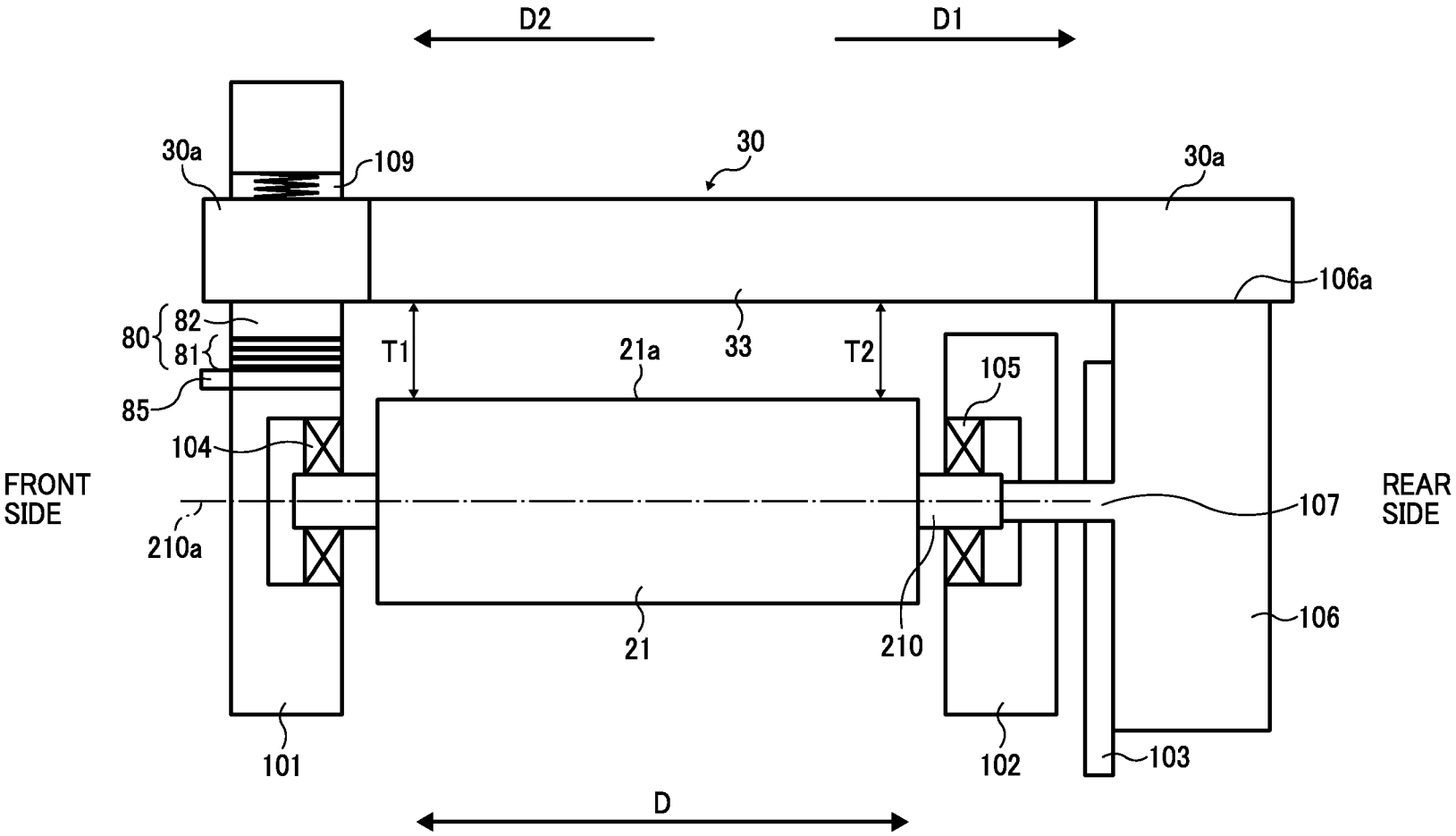
FIG. 3 is a diagram illustrating a supporting configuration of a charger according to an embodiment.

Referring to FIG. 3, a structure that supports the photoconductor 21 is described.

The drum-shaped photoconductor 21 has a rotating shaft 210. Ball bearings 104 and 105 at both ends in a longitudinal direction of the rotating shaft 210 to rotatably support the rotating shaft 210 of the photoconductor 21. By so doing, both ends of the rotating shaft 210 of the photoconductor 21 are attached to a front panel 101 and a rear panel 102 disposed at both ends of the process cartridge 20 in an axial direction of the process cartridge 20 indicated by arrow D in FIG. 3. The front panel 101 and the rear panel 102 of the process cartridge 20 function as supporting members to support and hold the photoconductor 21. The direction D represents a main scanning direction and a longitudinal direction of the charger 30. In the present embodiment, a direction indicated by arrow D1 represents an attaching direction in which the charger 30 is inserted into and attached to the process cartridge 20 and a direction indicated by arrow D2 represents a detaching direction in which the charger 30 is pulled out from the process cartridge 20 to be detached.

An apparatus body side plate 103 is disposed at a position close to the ball bearing 105. A photoconductor driving unit 106 is attached to the apparatus body side plate 103. The photoconductor driving unit 106 has a drive transmitter 107 that is projected therefrom in a manner of going through the apparatus body side plate 103. In the present embodiment, when the process cartridge 20 is attached to the apparatus body 120 of the image forming apparatus 100, the drive transmitter 107 is inserted into the rear panel 102, so that a driving force from the photoconductor driving unit 106 is transmitted to the rotating shaft 210 of the photoconductor 21.

Figure 4:
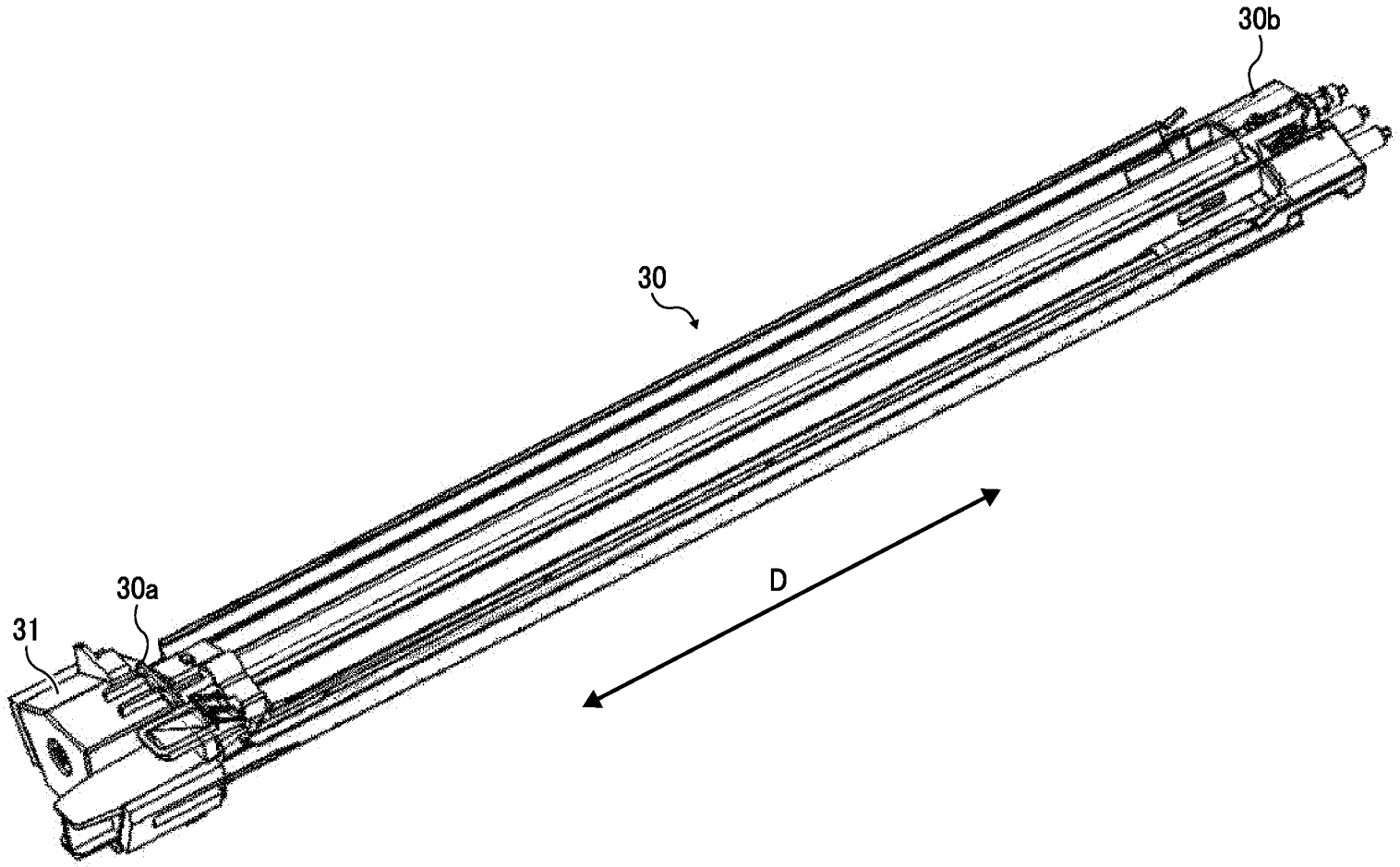
FIG. 4 is a perspective view illustrating an outer appearance of the charger.

As illustrated in FIG. 3, the charger 30 extends in the axial direction D and has a front part 30*a* and a rear part 30*b* in the axial direction D. The front part 30*a* and the rear part 30*b* of the charger 30 are detachably attached to the front panel 101 of the process cartridge 20 and an upper surface 106*a* of the photoconductor driving unit 106. A cover 31 is attached to the front part 30*a* of the charger 30, as illustrated in FIG. 4. When the charger 30 is attached to or detached from the apparatus body 120, a user holds the cover 31 to insert or remove the charger 30 with respect to the apparatus body 120 from the front side of the apparatus body 120 of the image forming apparatus 100.

In the present embodiment, the charger 30 is arranged parallel with an axis 210*a* of the rotating shaft 210 of the photoconductor 21 in an attaching state to the apparatus body 120 of the image forming apparatus 100. Accordingly, a distance T1 between the front part 30*a* side of the charger 30 and a front side end of the surface 21*a* of the photoconductor 21 and a distance T2 between the rear part 30*b* of the charger 30 and a rear side end of the surface 21*a* of the photoconductor 21 are set to be the same. That is, the charger 30 is attached so as to have no deviation between the distances T1 and T2 at both ends of the photoconductor 21 and the charger 30 in the main scanning direction of the charger 30. The term "deviation" represents a difference between the distances T1 and T2.

Figure 5:
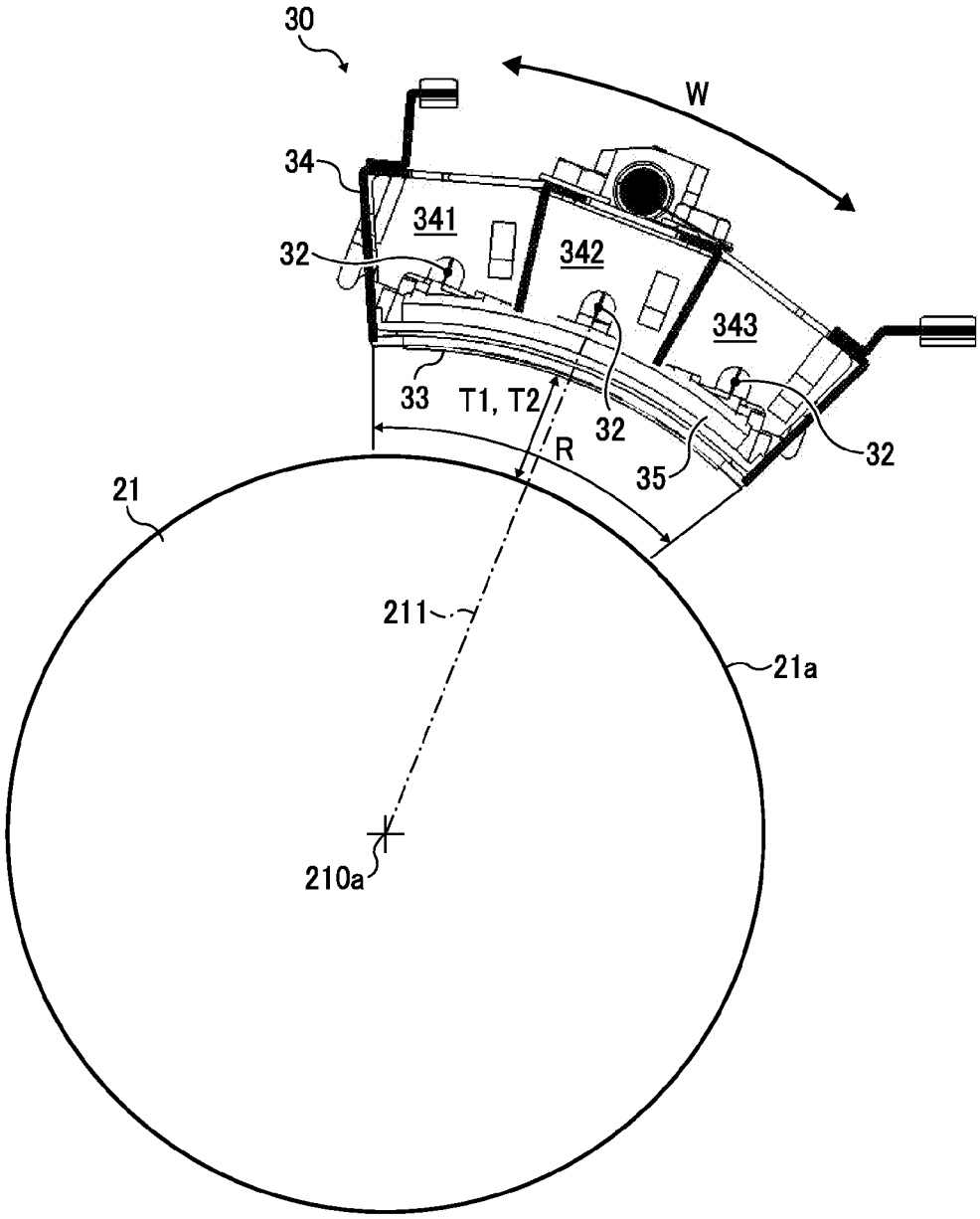
FIG. 5 is an enlarged view of a positional relation of the configuration of the charger and an image carrier, viewed from an attaching direction of attaching the charger.

The charger 30 is a corona discharging type and includes multiple wires 32, a grid electrode 33, and a casing 34 as illustrated in FIG. 5. The multiple wires 32 are three wires in the present embodiment, to which a high voltage is applied. The grid electrode 33 is a mesh-type electrode to which a voltage is applied. The grid electrode 33 is disposed between each wire 32 and the surface 21*a* of the photoconductor 21. The casing 34 is a counter electrode of each wire 32. The wires 32, the grid electrode 33, and the casing 34 are attached to a base portion 35 of the charger 30. In the present embodiment, the casing 34 is divided into three chambers 341, 342, and 343 in a photoconductor circumferential surface direction W. The respective wires 32 are disposed in the chambers 341, 342, and 343 to fix to the base portion 35. The charger 30 illustrated in FIG. 5 is not covered with the cover 31. It is to be noted that the photoconductor circumferential surface direction W is a sub-scanning direction.

In the present embodiment, the distances T1 and T2 between the surface 21*a* of the photoconductor 21 and the charger 30 is adjusted by a charger positioning adjuster 80, which is described below. The charger positioning adjuster 80 is provided because the deviation of the distances T1 and T2 between the charger 30 and the surface 21*a* of the photoconductor 21 in the main scanning direction can occur due to variations of parts or components and machine assembly. Each of the distances T1 and T2 represents a distance on a line segment 211 connecting a substantially center of an application region R of the charger 30 in the photoconductor circumferential surface direction W and the axis 210*a* of the rotating shaft 210 of the photoconductor 21.

Figure 6A:
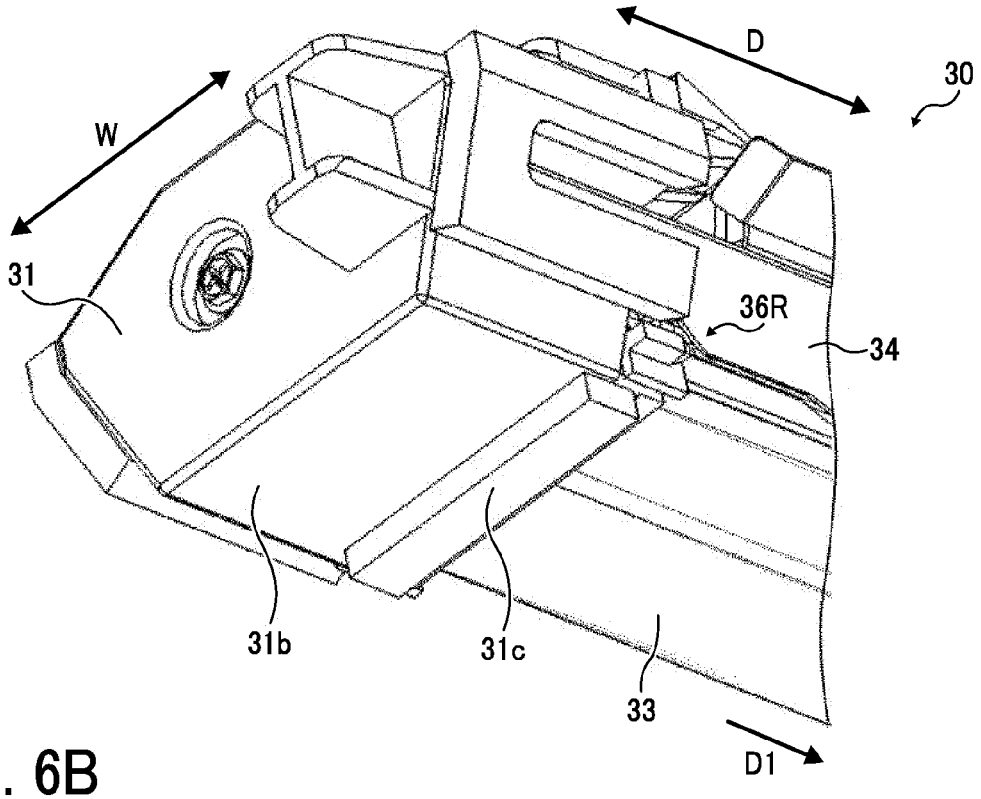
FIG. 6A is a partial enlarged perspective view illustrating the charger with a cover, viewed obliquely upward from the bottom of a front side configuration thereof.
Figure 6B:
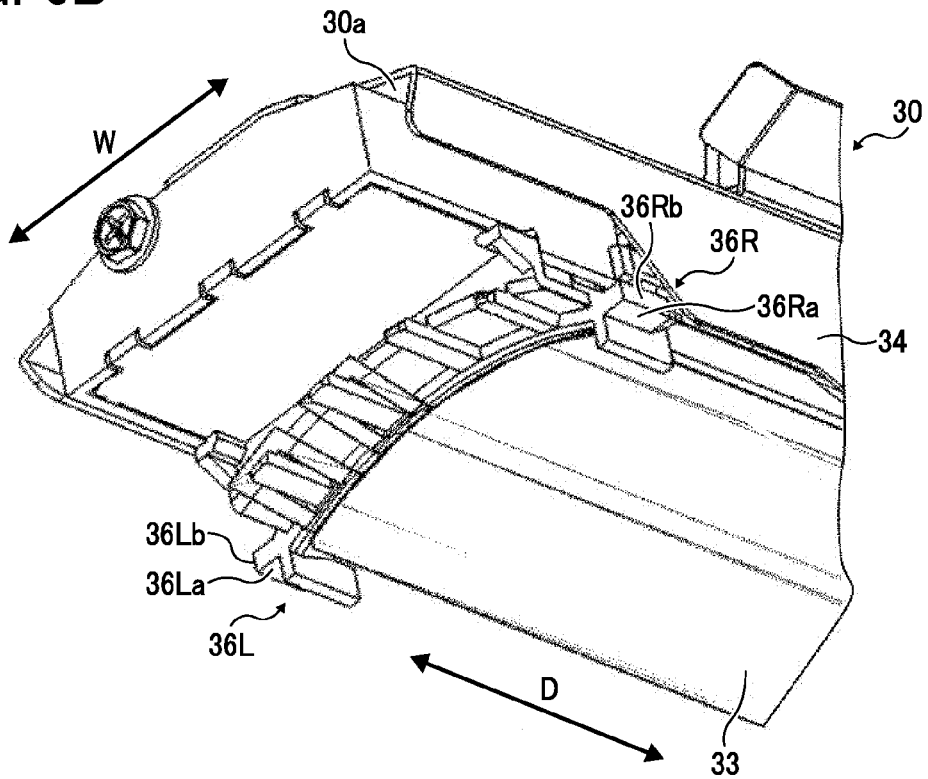
FIG. 6B is an enlarged perspective view illustrating the charger without the cover, viewed obliquely upward from the bottom of the front side configuration thereof.

As illustrated in FIGS. 6A and 6B, mounting parts 36L and 36R are disposed at a lower part of the front part 30*a* of the charger 30 in the photoconductor circumferential surface direction W. The mounting part 36L includes a mounting surface 36La and a guide surface 36Lb, and the mounting part 36R includes a mounting surface 36Ra and a guide surface 36Rb. A sponge seal 31C is disposed between the mounting parts 36L and 36R at a lower portion 31*b* of the cover 31. The sponge seal 31C functions as a seal member and protrudes downwardly. When the charger 30 is inserted through an opening 109 (refer to FIG. 3) to a given position, the sponge seal 31C shields a space formed between the front part 30*a* of the charger 30 and a lower part 109*a* (refer to FIG. 8) of the opening 109. The term "given position" represents a position where a lever provided at a center of the cover 31 of the charger 30 is caught about the opening 109 of the front panel 101.

It is to be noted that a spring for power supplying is provided to the rear part 30*b* of the charger 30. The spring for power supplying presses the charger 30 toward the front side of the image forming apparatus 100.

Figure 7A:
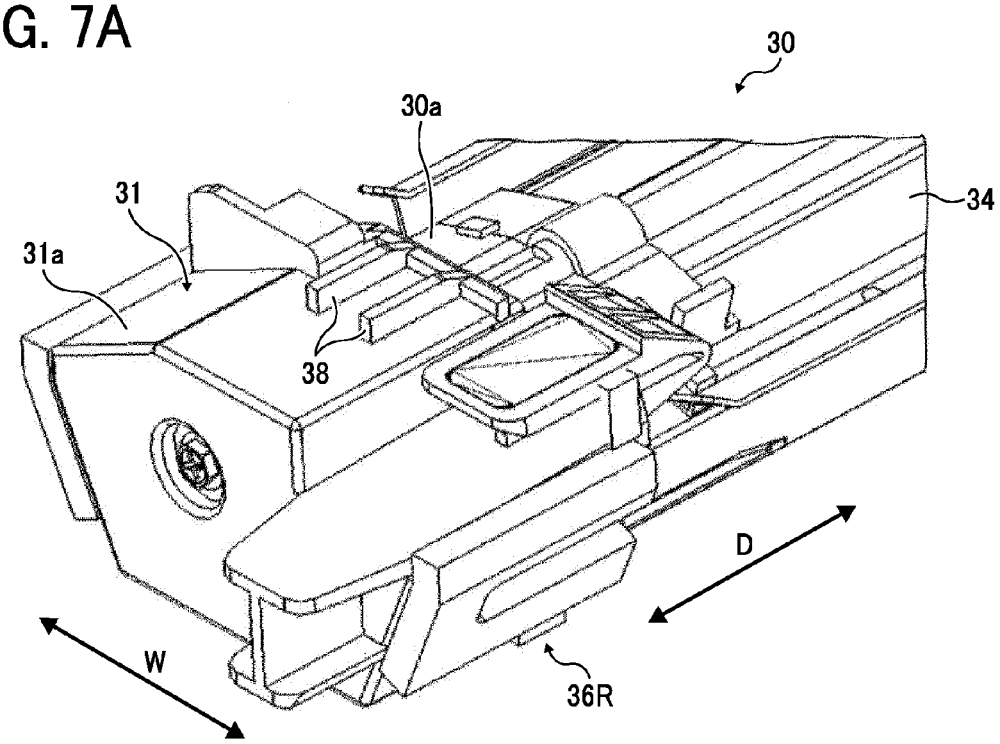
FIG. 7A is a partial enlarged perspective view illustrating the charger, viewed obliquely upward from the bottom of the front side configuration thereof.
Figure 7B:
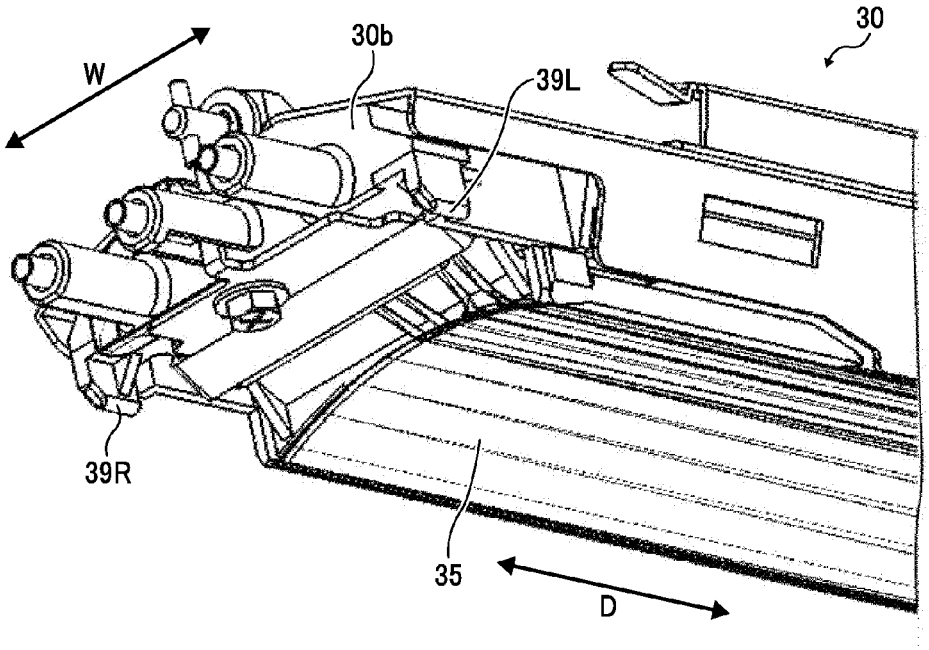
FIG. 7B is a partial enlarged perspective view illustrating the charger, viewed obliquely upward from a rear side configuration thereof.

As illustrated in FIG. 7A, a spring abutment rib 38 is provided on the upper portion 31*a* of the cover 31. The spring abutment rib 38 protrudes from the upper portion 31*a* toward an upward direction in FIG. 7A, so that the spring abutment rib 38 contacts a leading edge of a pressure spring (e.g., a leaf spring 111 described below). As illustrated in FIG. 7B, protrusions 39L and 39R are provided at both ends in the photoconductor circumferential surface direction W of the rear part 30*b* of the charger 30. The protrusions 39L and 39R are placed on the upper surface 106*a* of the photoconductor driving unit 106.

Next, a description of a configuration and functions of the position adjuster 80 that adjusts the deviation of the distances T1 and T2 between the charger 30 and the surface 21*a* of the photoconductor 21 at the front and rear sides of the process cartridge 20.

Figure 8:
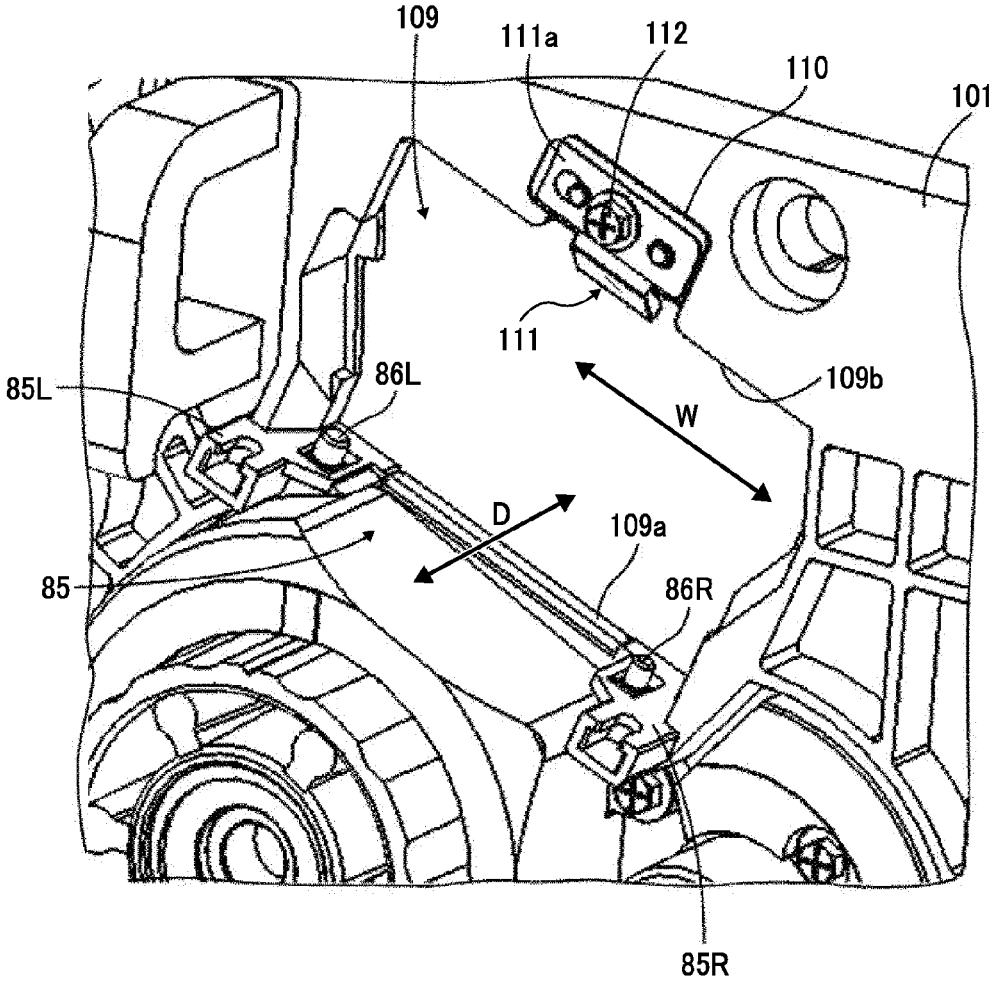
FIG. 8 is a partial enlarged perspective view illustrating a mounting part of the charger included in the image forming apparatus.
Figure 9:
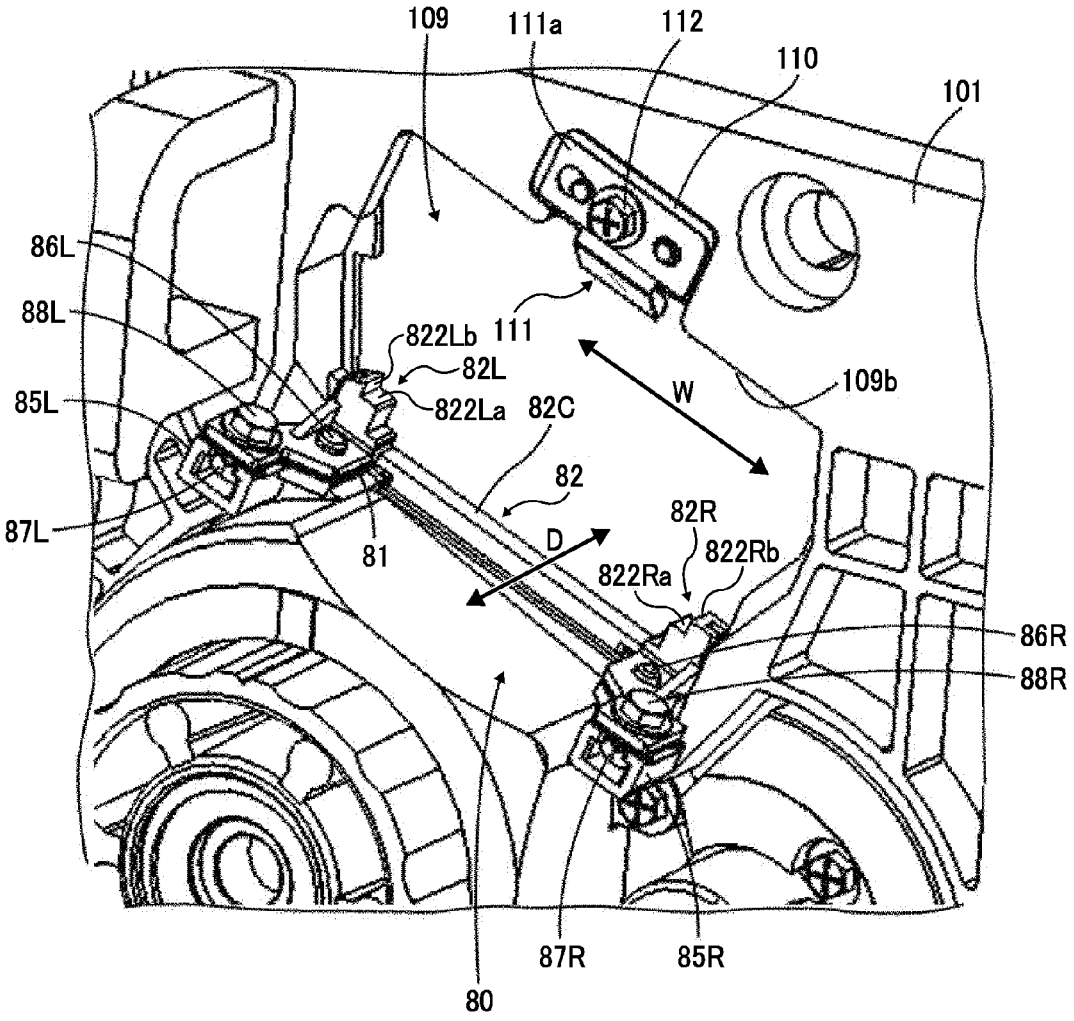
FIG. 9 is a partial perspective view illustrating a charger positioning adjuster included in the image forming apparatus.

As illustrated in FIGS. 8 and 9, the opening 109 through which the charger 30 is attached and detached is formed in the axial direction D through the front panel 101 of the process cartridge 20 that holds the photoconductor 21. The opening 109 has a similar shape as an external appearance of the charger 30 with the cover 31 attached. A space can be formed between a rim of the opening 109 and the charger 30. In the present embodiment, the opening 109 functions as a portion through which the charger 30 is attached and detached.

A mounting part 85 is provided in the vicinity of both ends of the lower part 109*a* of the opening 109. The mounting part 85 includes fixing parts 85L and 85R and pins 86L and 86R. The fixing parts 85L and 85R are disposed at both ends of the opening 109 in the photoconductor circumferential surface direction W. The pins 86L and 86R function as guide members. As illustrated in FIG. 9, a nut 87L and a bolt 88L are attached to the fixing part 85L, and a nut 87R and a bolt 88R are attached to the fixing part 85R, so that the charger positioning adjuster 80 is attached. The pins 86L and 86R are located closer to mounting parts 82L and 82R, which is described below, than the fixing parts 85L and 85R are. The pins 86L and 86R protrude more upward or higher than the lower part 109*a* of the opening 109. Respective protruding amounts of the pins 86L and 86R are determined such that at least one spacer 81 can be attached. The pins 86L and 86R are disposed closer to the mounting parts 82L and 82R in order to reduce the deviation of distances between the pins 86 and the mounting parts 82 (i.e., the distance between the pin 86L and the mounting part 82L and the distance between the pin 86R and the mounting part 82R) as much as possible, so that the deviation of the distances T1 and T2 can be reduced.

Figure 10:
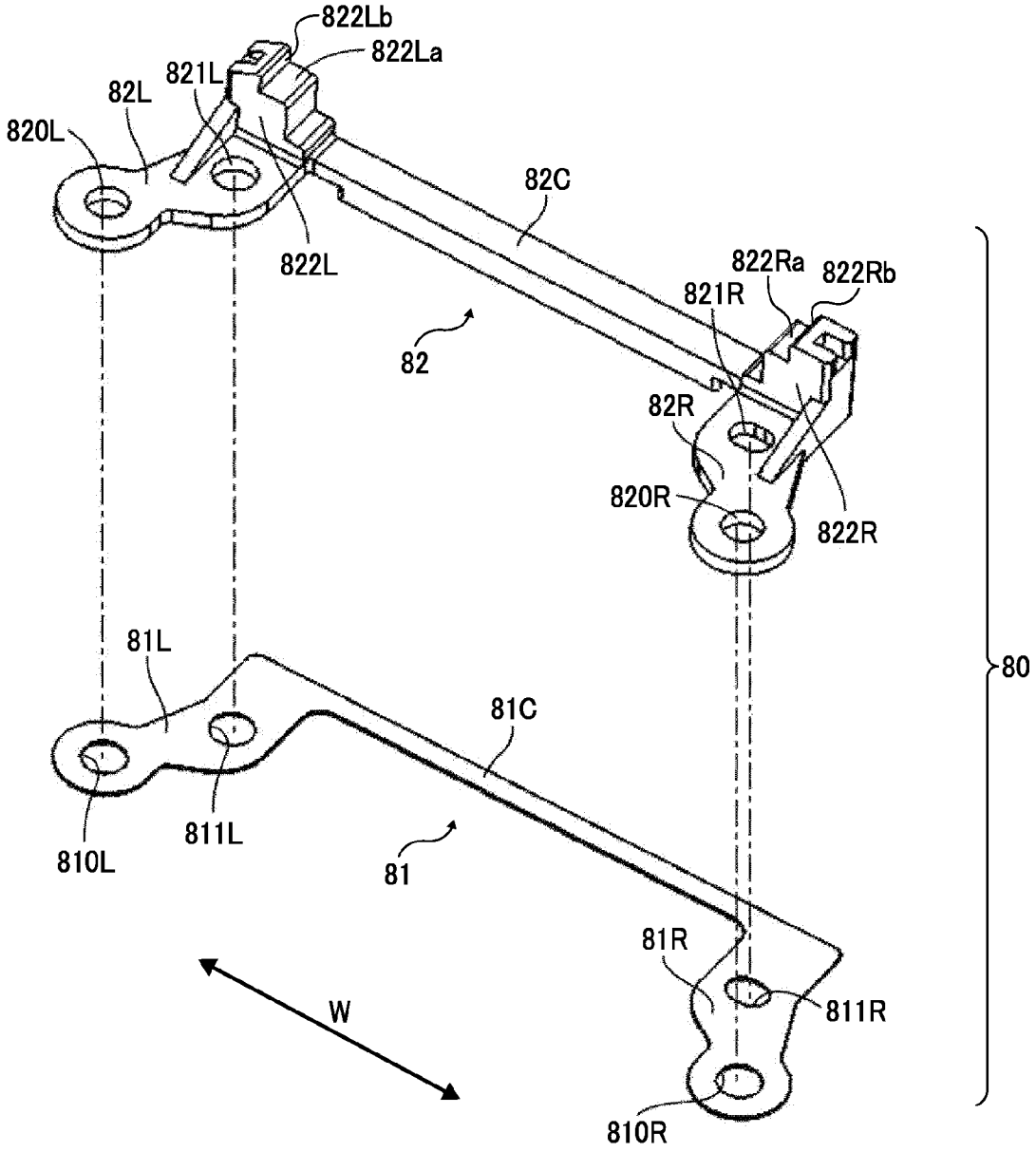
FIG. 10 is a partial enlarged view illustrating of the charger positioning adjuster.

As illustrated in FIG. 9, the position adjuster 80 includes a spacer 81 and the positioning member 82. As illustrated in FIG. 10, the spacer 81 has a substantially door frame shape on a plane and has attaching portions 81L and 81R at both ends opposed to each other. The attaching portion 81L has a bolt hole 810L and a pin hole 811L, and the attaching portion 81R has a bolt hole 810R and a pin hole 811R. The bolt holes 810L and 810R are provided so that the bolts 88L and 88R can go through the bolt holes 810L and 810R. The pin holes 811L and 811R are provided so that the pins 86L and 86R can go through the pin holes 811L and 811R. The pin hole 811R is a long slit extending in the photoconductor circumferential surface direction W, so as to absorb variations of the spacer 81 and the fixing parts 85L and 85R in the photoconductor circumferential surface direction W. The spacer 81 is a sheet metal plate and has a thickness of 0.1 mm in the present embodiment.

Figure 11:
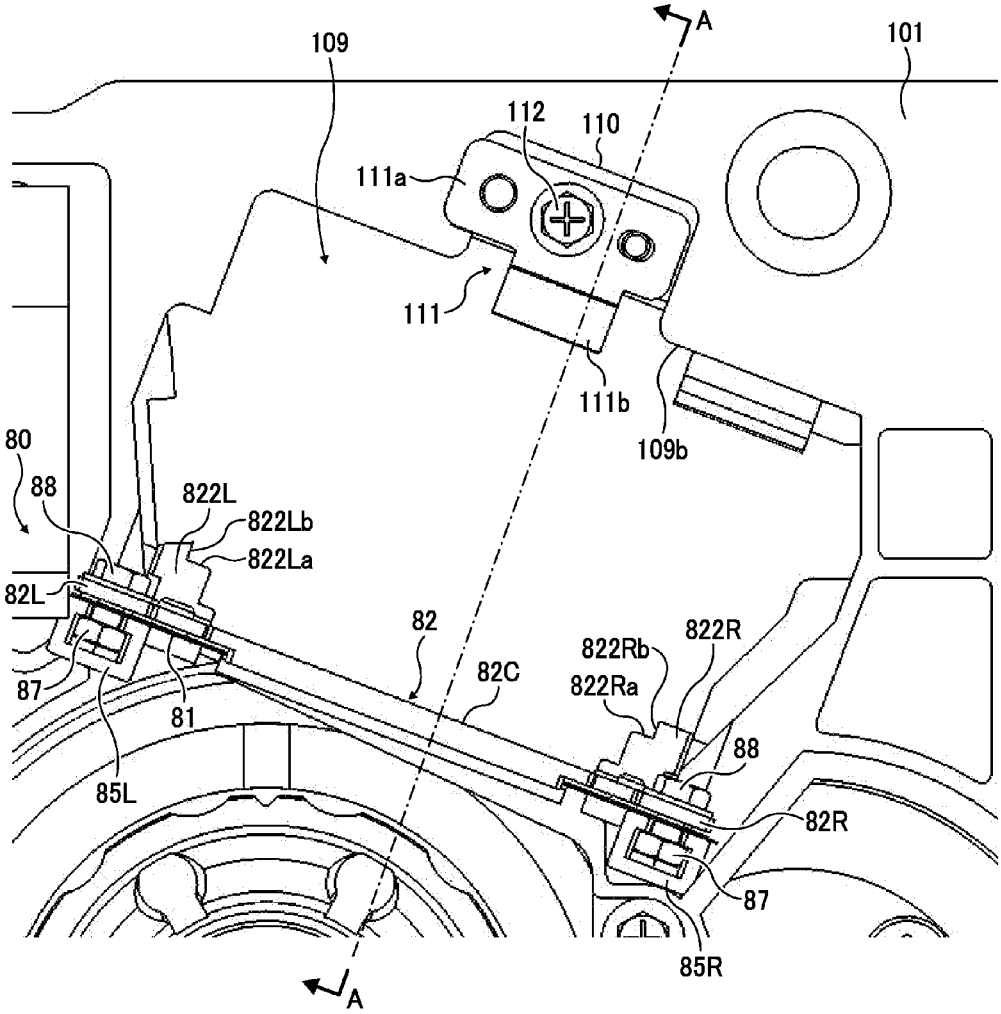
FIG. 11 is a partial enlarged view illustrating the position adjuster, vied from the attaching direction of the charger.

As illustrated in FIGS. 9 and 11, on the spacer 81 as described above, the attaching portion 81L and the attaching portion 81R are placed onto the fixing part 85L and the fixing part 85R, respectively, and a connecting portion 81C that connects the attaching portion 81L and the attaching portion 81R is placed onto the lower part 109*a* of the opening 109. Specifically, while the pins 86L and 86R are inserted into the pin holes 811L and 811R of the attaching portions 81L and 81R, respectively, the spacer 81 is attached onto the fixing parts 85L and 85R and the lower part 109*a*.

As illustrated in FIG. 5, a thickness direction of the spacer 81 is identical to the direction of line segment 211 that connects the substantially center of the application region R of the charger 30 in the photoconductor circumferential surface direction W and the axis 210*a* of the rotating shaft 210 of the photoconductor 21. Specifically, the thickness direction of the spacer 81 is a direction of increase and decrease of the distance T1 between the surface 21*a* of the photoconductor 21 and the grid electrode 33 below the chamber 342 as illustrated in FIG. 3.

In FIG. 10, the positioning member 82 that is made of resin material has a door frame shape on a plane and includes the mounting parts 82L and 82R at both ends opposed to each other of the positioning member 82. The mounting part 82L has a bolt hole 820L and a pin hole 821L, and the mounting part 82R has a bolt hole 820R and a pin hole 821L. The bolt holes 820L and 820R are provided so that the bolts 88L and 88R can go through the bolt holes 820L and 820R. The pin holes 821L and 821R are provided so that the pins 86L and 86R can go through the pin holes 821L and 821R. The pin hole 821R is a long slit extending in the photoconductor circumferential surface direction W.

The mounting parts 36L and 36R of the charger 30 are placed on the mounting parts 82L and 82R of the charger positioning adjuster 80. By receiving the mounting parts 36L and 36R from above, the mounting parts 82L and 82R hold the mounting parts 36L and 36R thereon and position the charger 30. The mounting parts 82L and 82R of the positioning member 82 are placed on the attaching portions 81L and 81R of the spacer 81, respectively, and a connecting portion 82*c* that connects the mounting parts 82L and 82R. By placing the mounting parts 82L and 82R and the connecting portion 81C from above, the positioning member 82 and the spacer 81 are attached to the mounting part 85. Specifically, the bolt holes 810L and 810 of the spacer 81 and the bolt holes 820L and 820R of the positioning member 82 are positioned, respectively, and the pin holes 811L and 811R of the spacer 81 and the pin holes 821L and 821R of the positioning member 82 are positioned, respectively. Then, the pins 86L and 86R are inserted into the pin holes 821L and 821R, respectively. By so doing, the positioning member 82 and the spacer 81 are set on the mounting part 85 of the front panel 101 of the process cartridge 20, so that the connecting portion 81C and the mounting parts 82L and 82R are positioned in the opening 109. Then, as illustrated in FIG. 11, the nuts 87L and 87R are attached to the fixing parts 85L and 85R, respectively. The bolts 88L and 88R are then inserted into the bolt holes 820L and 820R and the bolt holes 810L and 810R from above, respectively, and fixed to the nuts 87L and 87R, respectively. By so doing, the spacer 81 and the positioning member 82 are integrally fixed to the fixing parts 85L and 85R of the front panel 101.

As illustrated in FIGS. 9 and 11, the mounting parts 82L and 82R has mounting parts 822L and 822R, respectively. The mounting parts 822L and 822R have frame mounting surfaces 822La and 822Ra and side guide surfaces 822Lb and 822Rb, respectively. When the charger 30 is attached to the process cartridge 20, the frame mounting surfaces 822La and 822Ra and the side guide surfaces 822Lb and 822Rb of the mounting parts 822L and 822R contact the mounting surfaces 36La and 36Ra and the guide surfaces 36Lb and 36Rb of the charger 30, respectively. Specifically, when the charger 30 is inserted into the process cartridge 20, the frame mounting surfaces 822La and 822Ra of the mounting parts 822L and 822R receive the mounting surfaces 36La and 36Ra from above, so that the positioning member 82 is positioned in a vertical direction of the charger 30. The vertical direction of the charger 30 represents the direction of increase and decrease of the distance T1 between the surface 21*a* of the photoconductor 21 and the grid electrode 33 at the center of the charger 30. Further, during the attachment of the charger 30 to the process cartridge 20, when the mounting surfaces 36La and 36Ra of the charger 30 are placed on the frame mounting surfaces 822La and 822Ra of the mounting parts 822L and 822R from above. By so doing, the side guide surfaces 822Lb and 822Rb of the mounting parts 822L and 822R contact the guide surfaces 36LB and 36Rb of the charger 30, so that the positioning member 82 is positioned in the photoconductor circumferential surface direction W (i.e., the sub-scanning direction) of the charger 30.

Figure 12:
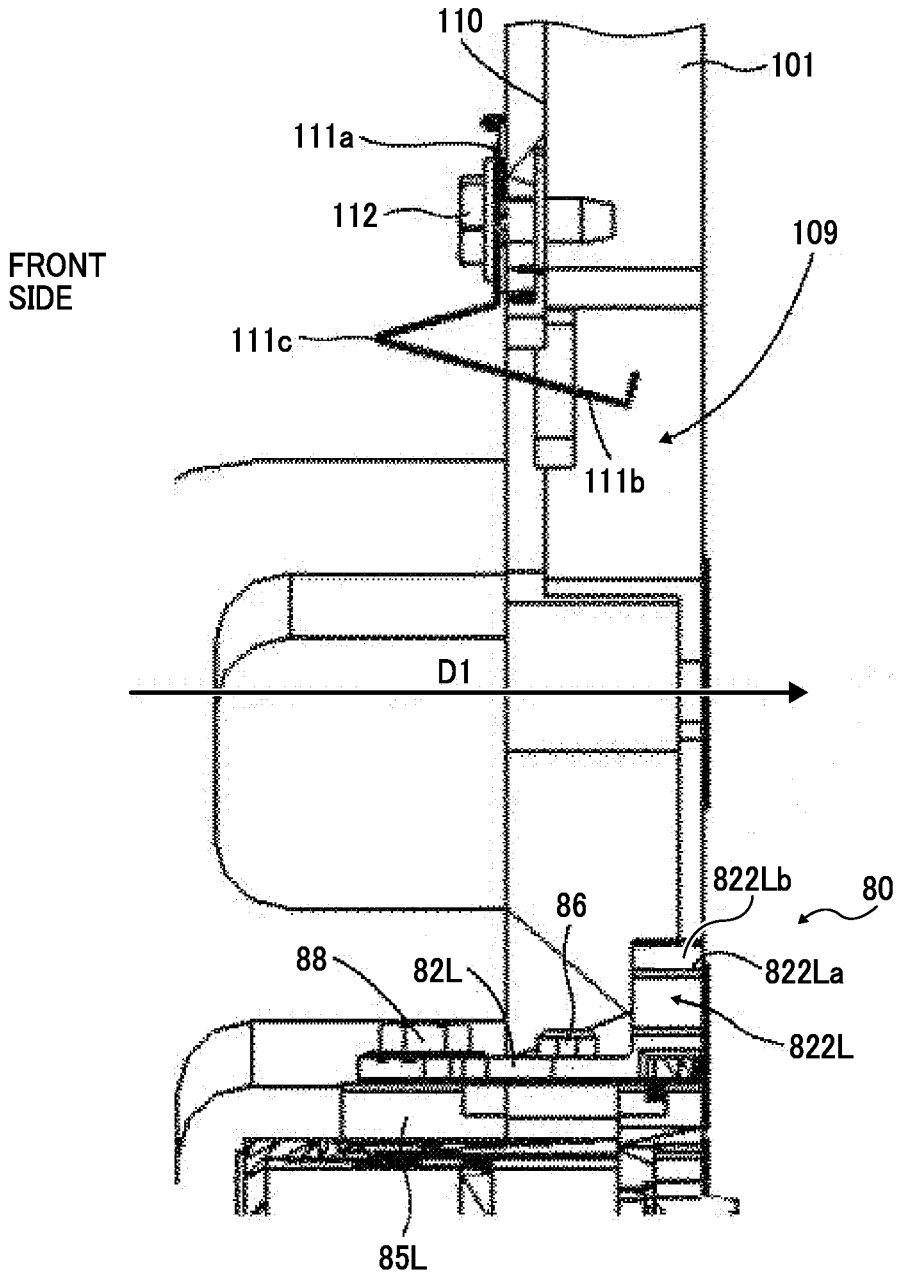
FIG. 12 is a cross-sectional view along a line A-A of FIG. 11.

By contrast, as illustrated in FIGS. 8, 9, and 11, a pedestal 110 is provided on an upper part 109*b* of the opening 109. The pedestal 110 includes a leaf spring 111 that functions as a biasing member. The leaf spring 111 biases the charger 30 attached to the process cartridge 20 toward the positioning member 82. The leaf spring 111 has one end 111*a* that is fixed to the pedestal 110 with a bolt 112 and an opposite end 111*b* that is a free end opposed to the one end 111*a*. As illustrated in FIG. 12, a curved portion 111*c* is formed between the one end 111*a* and the opposite end 111*b*. The curved portion 111*c* projects beyond the front panel 101 toward the front side of the process cartridge 20. The opposite end 111*b* of the leaf spring 111 is arranged to contact to and press against the spring abutment rib 38 of the cover 31 in the opening 109 when the charger 30 is disposed at the given position in the process cartridge 20.

Figure 13:
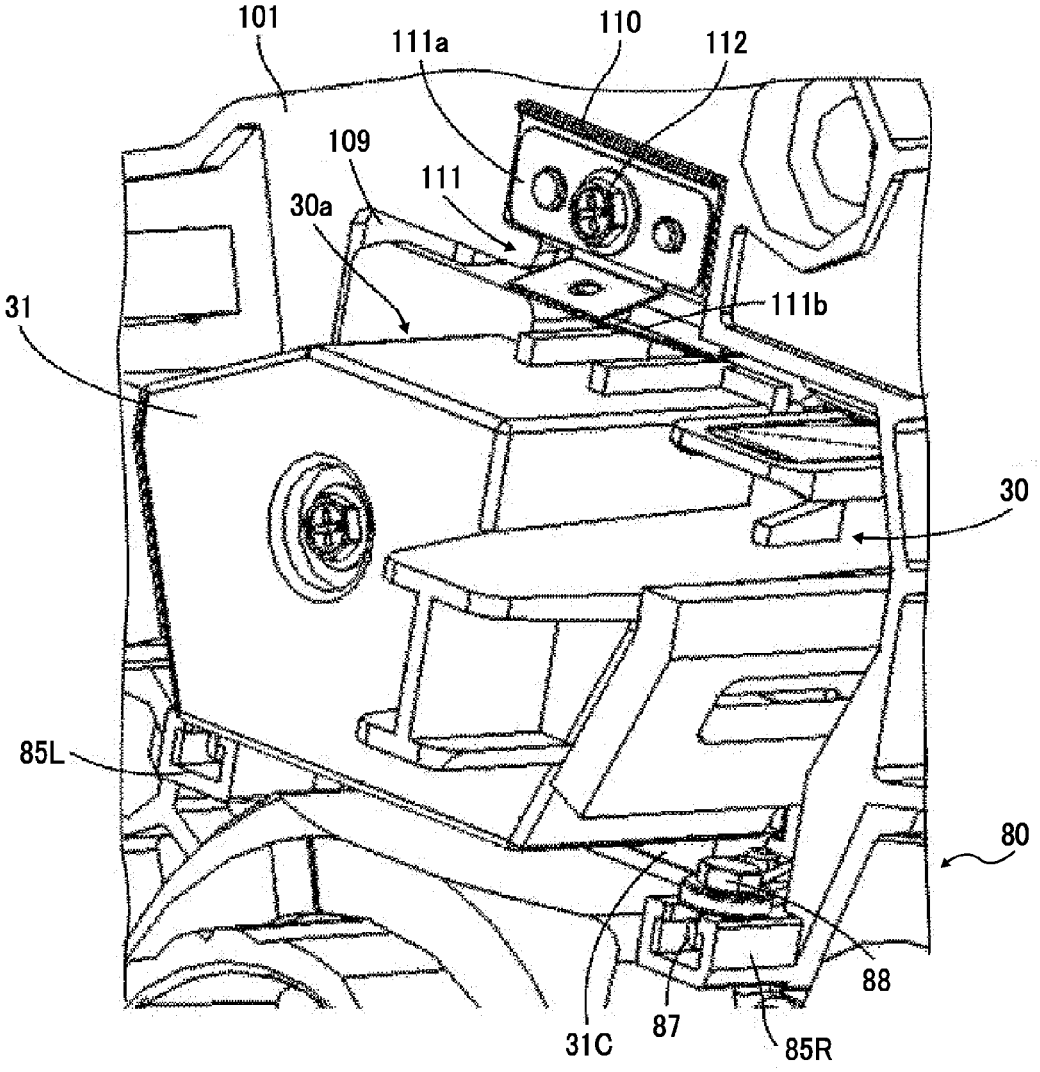
FIG. 13 is a partial enlarged perspective view illustrating a front side of the charger attached to the image forming apparatus.
Figure 14:
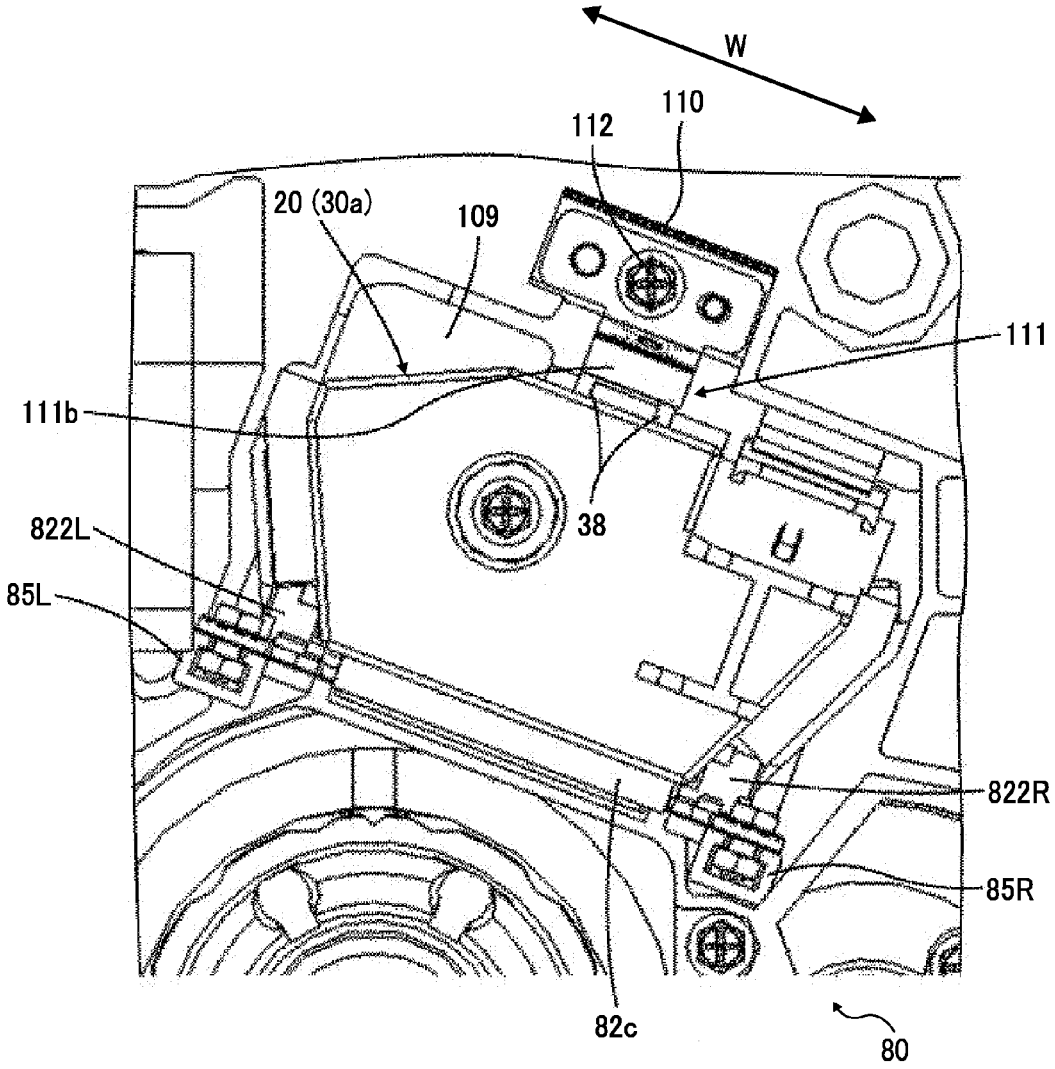
FIG. 14 is a partial enlarged perspective view illustrating the front side of the charger attached to the image forming apparatus, viewed from the attaching direction of the charger.
Figure 15:
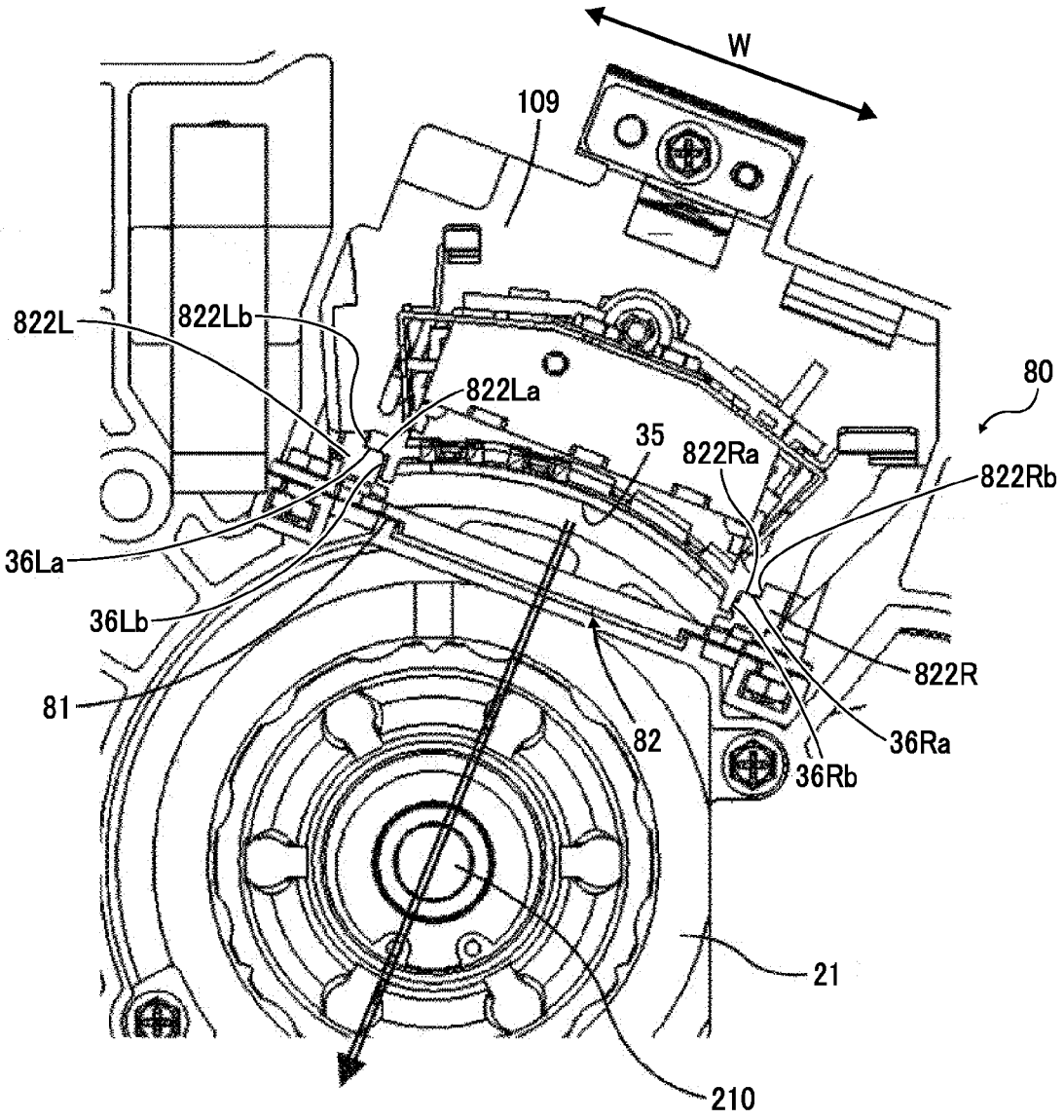
FIG. 15 is a partial enlarged perspective view illustrating of the supporting state of the charger positioning adjuster to the front side of the charger attached to the image forming apparatus, viewed from the attaching direction of the charger.

With this configuration, the charger 30 is attached to the apparatus body 120 of the image forming apparatus 100 by inserting the rear part 30*b* of the charger 30 from the front side 101 into the opening 109 of the apparatus body 120 and pushing the charger 30 in the attaching direction D1 as illustrated in FIG. 3. Accordingly, as the charger 30 moves in the attaching direction D1 and the lever of the cover 31 contacts the front panel 101, movement of the charger 30 in the attaching direction D1 is limited, so that the charger 30 is positioned at the given position in the axial direction D as illustrated in FIGS. 13 and 14. When the charger 30 comes to the given position, the mounting parts 36L and 36R of the charger 30 come on the mounting parts 82L and 82R of the positioning member 82, respectively. Consequently, the position of the charger 30 in the vertical direction (i.e., the direction of increase and decrease of the distance T) is determined by contacting the mounting surfaces 36La and 36Ra of the charger 30 with the frame mounting surfaces 822La and 822Ra of the mounting parts 822L and 822R, and the position of the charger 30 in the photoconductor circumferential surface direction W is determined by contacting the guide surfaces 36LB and 36Rb of the charger 30 with the side guide surfaces 822Lb and 822Rb of the mounting parts 822L and 822R.

With the charger positioning adjuster 80 provided to the front panel 101 as described above, the position of the charger 30 with respect to the positioning member 82 can be adjusted by changing the number of spacers 81. That is, the charger positioning adjuster 80 can adjust the distance T1 between the charger 30 and the surface 21*a* of the photoconductor 21 at the front part 30*a* of the charger 30 illustrated in FIG. 3. Therefore, the distance T1 between the charger 30 and the surface 21*a* of the photoconductor 21 can be adjusted without using an electric drive source. Consequently, the distance between the charger 30 and the photoconductor 21 can be adjusted with a simple and compact configuration, so that the deviation in the main scanning direction can be reduced. As a result, the deviation of the electric potentials of the charged surface 21*a* at the front and rear sides of the image forming apparatus 100 can be prevented, thereby enhancing the deviation of image concentration at the front and rear sides thereof.

In the present embodiment, a single distance, i.e., the distance T1 between the charger 30 and the surface 21*a* of the photoconductor 21, in the longitudinal direction of the charger 30 can be adjusted to reduce the deviation of the distances T1 and T2. Accordingly, a smaller and simpler configuration can be achieved.

Further, the front part 30*a* of the charger 30 is biased by the leaf spring 111 toward the positioning member 82. Therefore, shifting of the charger 30 in the vertical direction (i.e., in the direction in which the distance T1 increases or decreases) is further restricted. As a result, the deviation of the distances T1 and T2 can be reduced.

By contrast, the rear part 30*b* of the charger 30 is held by the photoconductor driving part 106 that has a relatively small positional shift with respect to the photoconductor 21. Therefore, the distance T2 can be determined at the rear part 30*b* of the charger 30. Thus, the distance T2 between the rear part 30*b* of the charger 30 and the surface 21*a* of the photoconductor 21 is fixed, so that the distance T1 between the front part 30*a* of the charger 30 and the surface 21*a* of the photoconductor 21 can be adjusted by changing the number of spacers 81. Accordingly, this configuration can facilitate adjustment of the deviation of the distances T1 and T2 between the charger 30 and the surface 21*a* of the photoconductor 21, so as to reduce the deviation thereof. As a result, the deviation of the electric potentials of the charged surface 21*a* at the front and rear sides of the image forming apparatus 100 can be prevented, thereby enhancing the deviation of image concentration at the front and rear sides thereof.

Instead of the upper surface 106*a* of the photoconductor driving unit 106, the rear part 30*b* of the charger 30 can be supported by the rear panel 102 of the process cartridge 20 by which the photoconductor 21 is held.

In the present embodiment, the position of the front part 30*a* of the charger 30 is adjusted from a view of adjustment operability. However, the positional adjustment of the charger positioning adjuster 80 is not limited to be performed at the front part 30*a* of the charger 30. For example, the distance T2 can be adjusted by disposing the positioning member 82 on the rear panel 102 of the process cartridge 20 or the upper surface 106*a* of the photoconductor driving unit 106 via the spacer(s) 81 to form the mounting parts 36L and 36R on the rear part 30*b* of the charger 30. Alternatively, both of the distances T1 and T2 can be adjusted by providing the mounting parts 36L and 36R on the front part 30*a* and the rear part 30*b* of the charger 30, respectively, to dispose the spacer(s) 81 and the positioning member 82 on the front panel 101 and the rear panel 102 or the upper surface 106*a* of the photoconductor driving unit 106.

In the present embodiment, the positioning member 82 that holds the front part 30*a* of the charger 30 is supported by the front panel 101 of the process cartridge 20 disposed close to the photoconductor 21. According to this configuration, the deviation between the distance T1 or the distance T2 from the charger 30 to the surface 21*a* of the photoconductor 21, and therefore a margin of positional adjustment of the distances T1 and T2 can be reduced.

Alternatively, the mounting part 85 can be provided on a side plate of the apparatus body 120 of the image forming apparatus 100 to be held by the positioning member 82 and the apparatus body 120, even though the margin of positional adjustment of the distances T1 and T2 increases.

Further, the thickness of a single spacer 81 is approximately 0.1 mm in the present embodiment. However, the optimal thickness of the spacer 81 can be selected according to the margin of the positional adjustment of the charger 30 and target deviations at the front and rear sides of the image forming apparatus 100.

Further, from the view of adjustment operability, the distance T1 is adjusted by changing the number of spacers 81 having the same thickness in the present embodiment. However, the spacers 81 can have different of thicknesses. The position of the charger 30 with respect to the surface 21*a* of the photoconductor 21 can be changed by combining the spacers 81 of different thicknesses, so that the distance T1 or T2 can be adjusted.

In the present embodiment, the spacer 81 is metal plated. Therefore, the change of the distance T1 or T2 from the charger 30 to the surface 21*a* of the photoconductor 21 can be reduced, and therefore the deviation of the distance T1 or T2 can be further reduced or eliminated.

As described above, the configuration of the charger and the image forming apparatus according to an embodiment is effective to achieve a reduction in deviation in the main scanning direction of the distance between the charger and the image carrier without employing an electric drive source. Specifically, the charger positioning adjuster of the charger that uniformly charges the surface of the image carrier by using corona discharging includes a mounting part disposed at a part where the charger is attached to or detached from, a positioning member mounted on the mounting part and determines a position of the charger by contacting the charger, and a spacer to adjust a distance between the surface of the image carrier and the charger by disposing between the mounting part and the positioning member. By changing the number of spacers and the thickness of the position adjuster, the location of the positioning member can be shifted in the accumulating direction of spacers. In this case, the accumulating direction of spacers represents a direction in which a distance of the charger and the image carrier increases or decreases. With this arrangement, the deviation in the main scanning direction of a distance between the charger and the image carrier can be reduced in a compact and simple configuration without using an electric drive source such as a motor. As a result, deviation of the surface potential of the image carrier in the main scanning direction after charging can be prevented.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A charger positioning adjuster to adjust a charger that is disposed facing an image carrier and uniformly charges a surface of the image carrier using corona discharging, the charger positioning adjuster comprising:

a mounting part provided at a position on which the charger is detachably attached;

a grid electrode provided between a front part and a rear part in an axial direction of the image carrier;

a positioning member attached to the mounting part and positioning the charger by contacting the charger; and a spacer disposed between the mounting part and the positioning member and adjusting a distance between the surface of the image carrier and the charger.

2. The charger positioning adjuster according to claim 1, wherein the distance between the surface of the image carrier and the charger represents a distance on a line segment connecting a substantially center of an application range of the charger in a circumferential direction of the image carrier and a rotation axis of the image carrier.

3. The charger positioning adjuster according to claim 1, wherein the spacer includes either one of a single plate and multiple plates having a thickness identical to each other.

4. The charger positioning adjuster according to claim 1, wherein the spacer is a sheet metal.

5. The charger positioning adjuster according to claim 1, wherein the mounting part is held by a supporting member supporting the image carrier.

6. The charger positioning adjuster according to claim 1, wherein the mounting part, the positioning member, and the spacer are disposed at one end of the charger in a longitudinal direction of the charger.

7. The charger positioning adjuster according to claim 1, further comprising a biasing member disposed facing the mounting part, and contacting and biasing the charger toward the positioning member when the positioning member positions the charger.

8. An image forming apparatus comprising:

an image carrier to form an image on a surface thereof;

a charger to uniformly charge the surface of the image carrier; and the charger positioning adjuster according to claim 1.

9. The charger positioning adjuster according to claim 1, wherein the spacer includes either one of a single plate and multiple plates to adjust the distance between the surface of the image carrier and the charger.

10. The charger positioning adjuster according to claim 1, wherein the multiple spacers includes either one of a single plate and multiple plates rest one atop another to adjust the distance between the surface of the image carrier and the charger.

11. The charger positioning adjuster according to claim 1, wherein the grid electrode is a mesh-type electrode to which voltage is applied thereto.

12. The charger positioning adjuster according to claim 1, further comprising multiple wires and a casing.

13. The charger positioning adjuster according to claim 12, wherein the grid electrode is disposed between the each wire and a surface of the image carrier.

* * * * *